US005119660A

United States Patent [19]

Koppinen et al.

[11] Patent Number: 5,119,660

[45] Date of Patent: Jun. 9, 1992

[54] METHOD FOR MANUFACTURING METAL OBJECTS

[75] Inventors: Ilpo I. Koppinen; Hannu T. Pajala, both of Pori; Jukka V. A. Somerkoski, Ulvila, all of Finland

[73] Assignee: Outokumpu Oy, Helsinki, Finland

[21] Appl. No.: 790,135

[22] Filed: Nov. 7, 1991

Related U.S. Application Data

[63] Continuation-in-part of Ser. No. 601,510, Oct. 23, 1990, abandoned.

[30] Foreign Application Priority Data

Aug. 6, 1990 [FI] Finland ..... 903845

[51] Int. Cl.[5] ..... B31C 23/02; B31C 33/00

[52] U.S. Cl. ..... 72/262; 72/253.1; 72/270

[58] Field of Search ..... 72/253.1, 262, 270; 164/476

[56] References Cited

U.S. PATENT DOCUMENTS

| | | | |
|---|---|---|---|
| Re. 32,399 | 4/1987 | Nagai et al. | 72/262 |
| 3,364,707 | 1/1968 | Foerster | 72/253.1 |
| 4,308,742 | 1/1982 | Harrison et al. | 72/273.5 |
| 4,393,917 | 7/1983 | Fuchs, Jr. | 72/262 |
| 4,732,551 | 3/1988 | East et al. | 72/262 |
| 4,823,586 | 4/1989 | Sinha et al. | 72/262 |

FOREIGN PATENT DOCUMENTS

| | | | |
|---|---|---|---|
| 29347 | 7/1984 | Japan | 164/476 |
| 309716 | 12/1989 | Japan | 72/262 |

OTHER PUBLICATIONS

The Extrusion of Metals by C. E. Pearson & R. N. Parkins; 2nd Ed.; published in 1960, pp. 184–187, pp. 243–253; and pp. 284–289 (TS 255 P4 1960).

Extrusion by K. Laue and H. Stenger; pub. in 1976 by Amer. Society for Metals; pp. 19–23 (TS 255 L 3).

U.K. Patent Application No. 2,095,592A; Pub. Date Oct. 1982 Inventor: Leo Cloostermans-Huwaert; 2 drwg & 3 pp. Spec.

WO87/06508; Pub. Date Nov. 5, 1987; Inventor: Brian Maddock; 4 sheet of drwg. 8 pp. of Spec.

E. P. No. 03677176; May 1990; Inventor: Kurt Buxmann; 2 sheets of drawing and 2 pp. of spec.

*Primary Examiner*—Robert L. Spruill
*Assistant Examiner*—Donald M. Gurley
*Attorney, Agent, or Firm*—Brooks Haidt Haffner & Delahunty

[57] ABSTRACT

The invention relates to a method for manufacturing metal objects, particularly non-ferrous metal objects, by means of extrusion. According to the invention a casting with a cast structure is conducted at or about ambient temperature to the extrusion device, and the casting is subjected to extrusion, at a reduction ratio of at least 80%, within its recrystallization region. The extrusion is carried out according to the Conform method.

1 Claim, No Drawings

METHOD FOR MANUFACTURING METAL OBJECTS

This application is a continuation-in-part, of application Ser. No. 07/601,510, filed Oct. 23, 1990, now abandoned.

The present invention relates to a method for manufacturing metal objects by means of extrusion, so that in connection with the extrusion, the material under treatment is subjected to recrystallization.

The GB patent 1,370,894 introduces a method known in the metal industry as the Conform method. In the said method, the material to be treated is fed into a groove in between two separate members. In the practical applications of the method, the groove is curved,, in which case one member is a wheel, on the circumference thereof the groove is formed. The other member is provided with an abutment essentially blocking the passageway, so that one end of the groove is blocked. In the vicinity of this blocked end of the groove, there is further formed a die orifice, wherethrough the material to be treated is extruded to produce the metal object having the form defined by the die orifice.

The material to be treated can be fed into the groove according to the Conform method either in granular, finely powdered, solid or even molten form. The feeding in molten form is described for instance in the U.S. Pat. No. 4,601,325, where the whole Conform apparatus is located essentially under the molten surface. The wheel comprising the groove provided in the Conform apparatus is cooled on the inside so that the material to be treated is solidified at least to a point where the surface of the material is congealed before entering the die orifice effecting the extrusion. In the WO publication 87/06508 there is described a procedure for using molten material, in which procedure the cooling of the molten takes place, with respect to the wheel, from the outer circumference thereof, and thus totally separately from the wheel.

As was maintained above, the material to be treated can also be fed in solid form. In that case the thermal energy from the structural change is increased. In order to reduce the structural change heat, the material is often fed in a granular or finely powdered form, which in part reduces the creation of heat. The effects of the heat are diminished, according to the U.S. Pat. No. 4,610,725, by conducting the cooling agent to the groove both through the material feed opening and through the special inlet for extra cooling agent. At the same time the temperature is adjusted for instance by inner cooling of the blocking member which closes the groove.

Owing to the structural change heat, the Conform method is generally applied only to materials with a low structural change temperature, such as aluminium, when the feed material is solid, for example rod-like. While applying the Conform method for instance to copper, the feeding often takes place in granular or finely powdered form. The feeding may also be carried out in rod-like form, but in that case it is advantageous to use for instance the cooling method discussed above and described in the U.S. Pat. No. 4,610,725. Furthermore, while using rod-like feed, the rod is cooled and subjected to preliminary working prior to the feeding in order to make the structure advantageous for extrusion.

In the working technique the structural change heat can also be used in the manufacture of for instance tubes, rods and strips so that the corresponding billet is cold-worked to a point where, owing to the structural change resistance, the temperature of the material under treatment rises to the recrystallization region, as is described, in connection with rolling, in the FI patent 77,057. The billet to be treated in rolling usually is already worked to the desired form; for instance a plate to be plate-like, a tube to be tube-like. In extrusion this kind of preworking does not have much purpose, because the idea of extrusion is to extrude the material under treatment through the die orifice either in molten or solid form, so that the extruded object obtains the form defined by the die orifice.

While studying extrusion for instance by means of the above described Conform method, it has now been surprisingly found out that the structural change heat can advantageously be utilized when the material to be treated is fed as cast to the extrusion device. In that case the temperature in the extrusion is advantageously adjusted to be such that the piece as cast to be extruded can be subjected to recrystallization in connection with the extrusion. Consequently the object of the present invention is to make use of this surprising discovery and to create a method for manufacturing metal objects, which method essentially simplifies the various steps connected to extrusion. The essential novel features of the invention are apparent from the appended patent claims.

According to the invention, the material to be treated is conducted as cast to the extrusion device such as an extrusion device using the Conform method, advantageously directly from the casting device so that the material is not subjected to any separate working step prior to the beginning of the extrusion. Thus the material is advantageously as cast when the extrusion begins. In the beginning of the extrusion there is defined such a reduction for the castable material that recrystallization takes place in the material during the extrusion process. The material as cast is at or about ambient temperature when it is subject to extrusion. There is no working of the cast material between casing and extrusion, and the as-cast material is clearly below any working (i.e. tempering or softening annealing) temperature.

When as cast, the structure of the material is rough and nonhomogeneous. Consequently the material does not endure large reduction without cracking, and therefore intermediate annealing becomes necessary. Moreover, the cold-worked surface often becomes optically defective, i.e. there is formed a so-called orange peel surface. When the material under treatment is a metal alloy, there are segregations in the casting structure, in which case cold working after the casting often is as much as impossible. In that case hot working is needed in order to create a small-grained intermediate product which endures cold working. According to the invention, while the material as cast is subjected to recrystallization in connection with extrusion, the structure of the material becomes essentially and advantageously small-grained. The essentially large reduction caused by the extrusion, at least 80%, advantageously reduces the recrystallization temperature, because while the reduction increases, the activation energy required by the recrystallization, i.e. the energy needed for starting the recrystallization process, decreases.

The method of the present invention can advantageously be applied to non-ferrous metals such as copper, aluminium, lead, zinc and cadmium, to metal alloys based on these metals as well as to possible alloys between these metals.

Recrystallization is a quantity typical of the material in question, and the starting of the process is dependent for instance on preliminary working, as well as, as was maintained above, on the reduction in the batch working. In the method of the invention, the employed recrystallization temperature range for instance for copper and copper-based metal alloys is 300°-850° C., and for aluminium and aluminium-based metal alloys 250°-450° C.

Example Oxygen-free copper was treated according to the method of the present invention by feeding material as cast to an extrusion device using the Conform method. The extrusion device comprised a curved groove which was lined with the material under treatment, in order to avoid mutual reactions between the structures of the device and the material under treatment. The rotation speed of the wheel of the Conform device, provided with the groove, was 20 revolutions per minute. The oxygen-free copper to be treated as cast was fed into the extrusion device in rod-like form, and the diameter of the rod was 12 mm. The pressure ratio in the extrusion device was 2.5, and the obtained extrusion product was metal profile, having the width of 14 mm and the thickness of 8 mm. In this case the recrystallization temperature was 800° C. and the grain size formed by the recrystallization was within the range of 10-25 μm.

Further experiments were carried out to determine the relationship between temperature and economics of production.

A rod was upcast in a separate location and having a coarse grained cast structure, the grain size being several millimeters, the rod was used as a feedstock material in the Conform process. The ambient temperature rod was fed into a groove of a rotating Conform extrusion wheel. The frictional grip pushed the material against a fixed abutment and the shear action on the material generated sufficient pressure and temperature to extrude it through a die to form a shaped product.

In the vicinity of the abutment and at entrance of the die (i.e. tooling area) the temperature of the material was estimated to have been raised to a temperature about 760° C., since the temperature of the outcoming product was measured by infrared eye to be about 760° C. Repeating the experiment, but with a higher rotation speed of the wheel, 20 rpm, the temperature of the outcoming product increased to about 800° C. The higher rotation speed means increasing production rate and thus it is advantageous. With still higher speeds of rotation, the temperature rose even more, and with the best available tooling materials an upper limit of production rate was reached.

The abrupt decrease of tooling lifetime when the production rate increased to a certain level was observed to be dependent upon the behaviour of the tooling materials used and closely followed the softening curve, which is hardness as a function of the annealing temperature with respect to measured temperatures of the outcoming product.

Based on the experiments described above the following conclusions can be drawn:

The lifetime of a given tooling material is dictated mainly by the working temperature, under which it has to operate.

On the other hand, the working temperature is dictated by the rotation speed of the Conform extrusion wheel or a production rate.

A certain level of production rate must be achieved in order to be able to produce copper products economically by Conform process.

Even the best available tooling materials are in the very sensitive range of economical production level.

Even a small increase of temperature, say 20° to 30° C., would destroy the basis for economical production.

If the feedstock material should essentially deviate in temperature from an ambient temperature level to several hundred degrees Celsius, it would affect the following:

For a given production rate of a given produce one would expect a minor decrease in a power demand, compared to that of ambient temperature feedstock.

Changing the temperature balance by increasing the temperature of the feedstock material would increase the temperature of the tooling materials. This would not be crucial at low production rates, on the contrary, that would be even beneficial in some cases. But considering economical production rates, temperature increase of feedstock material definitely would drop the production rate beyond any economic limit. Return of capital employed from an economic point of view thus dictates that the temperature of the feedstock material should be essentially at ambient temperature, and not significantly higher.

We claim:

1. A method for manufacturing metal objects from copper or copper-based metal alloy by means of Conform method extrusion comprising delivering a casting of copper or copper-based metal alloy directly from a casting step to a Conform method extrusion device at or about ambient temperature without intermediate working and extruding the casting at a reduction ratio of at least 80% to increase the temperature of the casting metal to within the recrystallization range of the casting metal.

* * * * *